US007498896B2

(12) United States Patent
Shi

(10) Patent No.: US 7,498,896 B2
(45) Date of Patent: Mar. 3, 2009

(54) WAVEGUIDE TO MICROSTRIP LINE COUPLING APPARATUS

(75) Inventor: Shawn Shi, Thousand Oaks, CA (US)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 11/796,518

(22) Filed: Apr. 27, 2007

(65) Prior Publication Data

US 2008/0266196 A1 Oct. 30, 2008

(51) Int. Cl.
*H01P 5/107* (2006.01)

(52) U.S. Cl. ..... 333/26; 333/33; 343/700 MS; 343/771

(58) Field of Classification Search ..... 343/700 MS, 343/772, 846, 829, 771; 333/26, 33
See application file for complete search history.

(56) References Cited

U.S. PATENT DOCUMENTS 4,453,142 A * 6/1984 Murphy ..... 333/26
4,679,249 A 7/1987 Tanaka et al.
4,843,400 A * 6/1989 Tsao et al. ..... 343/700 MS
5,170,174 A * 12/1992 Caer et al. ..... 343/771
5,245,745 A 9/1993 Jensen et al.
5,793,263 A 8/1998 Pozar
6,087,907 A 7/2000 Jain
6,127,901 A 10/2000 Lynch
6,144,266 A 11/2000 Heidemann et al.
6,377,217 B1 * 4/2002 Zhu et al. ..... 343/700 MS
6,822,528 B2 * 11/2004 Dawn et al. ..... 333/26
2006/0255875 A1 11/2006 Iio
2007/0024511 A1 2/2007 Li et al.

FOREIGN PATENT DOCUMENTS

EP 0 249 310 12/1987

OTHER PUBLICATIONS

CPW to Waveguide Transition with Tapered Slotline Probe; Ting-Huei Lin and Ruey-Beei Wu, Senior Member, IEE Microwave and Wireless Components Letters, vol. 11, No. 7, Jul. 2001, p. 314-316.
Microstrip Line to Waveguide Transition Connecting Antenna and Backed RF Circuits, Kunio Sakakibara, Fuminori Saito, Yuta Yamamoto, Naoki Ingagki and Nobuyoshi Kikuma, Department of Electrical and Computer Engineering, Nagoya Institute of Technology, Gokiso-cho, Showa-ku, Nagoya, 466-8555, Japan, p. 958-961, undated!

(Continued)

*Primary Examiner*—Tho G Phan
(74) *Attorney, Agent, or Firm*—Jimmy L. Funke

(57) ABSTRACT

Electrical coupling apparatus providing transition between a high radio frequency waveguide and a perpendicularly oriented microstrip line without use of a shorting cap fixes an open end of the waveguide perpendicularly to a dielectric substrate. The microstrip line is carried on the substrate and couples through a hole in the waveguide wall to a microstrip patch on the substrate within the waveguide having a resonance with the waveguide encompassing a predetermined high radio frequency bandwidth of signals to be conducted by the apparatus. A plurality of parallel conducting members form a via fence aligned with the waveguide wall and extending through the substrate to electrically connect the waveguide to a planar ground conductor that covers the opposite side of the substrate, including the area under the open end of the waveguide.

14 Claims, 5 Drawing Sheets

OTHER PUBLICATIONS

Rectangular Waveguide to Planar Structure Transitions for Antenna Applications, Winfried Simon, Sybille Holzwarth, Andreas Wien, Ingo Wolff, Fellow, IEEE, Institute of Mobile and Satellite Communication Techniques (IMST), Carl-Friedrich-Gauss-Straβe 2, D-47475 Kamp-Lintfort, Germany; email: simon@imst.de, undated!

A Novel Coplanar Transmission Line to Rectangle Waveguide Transition, W. Simon, M. Werthen and I. Wolff, Fellow, IEE, Institute of Mobile and Satellite Communication Techniques (IMST), Carl-Friedrich-Gauss-Straβe 2, D-47475 Kamp-Lintfort, Germany, undated!

A Full-Height Waveguide to Thin-Film Microstrip Transition with Exceptional RF Bandwidth and Coupling Efficiency, J.W. Kooi, G. Chattopadhyay, S. Withington, F. Rice, J. Zmuidzinas, C. Walker and G. Yassin, California Institute of Technology, MS 320-47 Pasadena, CA 91125, USA. IR & MM Waves, vol. 24, No. 3, 2003, p. 261-284.

Millimeter-Wave Microstrip Line to Waveguide Transition Fabricated on a Single Layer Dielectric Substrate; Hideo Iizuka, Toshiaki Watanabe, Kazuo Sato, Kunitoshi Nishikawa; Special Issue: Millimeter-Wave Radar for Automotive Applications, R&D Review of Toyota CRDL, vol. 37, No. 2, p. 13-18, undated!

EP Search Report dated Jul. 31, 2008.

* cited by examiner

WAVEGUIDE TO MICROSTRIP LINE COUPLING APPARATUS

TECHNICAL FIELD

The technical field of this invention is high frequency electrical conducting apparatus incorporating a coupling between a waveguide and a microstrip line.

BACKGROUND OF THE INVENTION

Electrical coupling providing transition between a microstrip line and a perpendicularly oriented waveguide is often needed for high radio frequency system integration. A typical such coupling arrangement is shown in FIGS. 1 and 2. A microstrip line 10 formed on an upper surface of a dielectric substrate 20 ends in a probe 12. A metallic layer 26 on the opposite, lower surface of substrate 20 provides a ground layer for microstrip line 10. A waveguide 30 has an end 32 attached to the upper surface of substrate 20 surrounding the probe; and a wall opening 34 in waveguide 30 adjacent substrate 20 provides access to the interior of the waveguide for microstrip line 10.

A quarter wavelength shorting cap 40 is attached to metallic layer 26 below the lower surface of substrate 20 directly under waveguide 30. Shorting cap 40 is coupled to waveguide 30 by a plurality of parallel conductors, including conductors 52, 54 and 56 as representative examples, forming a via fence through substrate 20 and the removal of the portion of metallic layer 26 within the via fence. Probe 12 is made as narrow as possible to minimize blockage of energy flow between the waveguide and shorting cap 40. Shorting cap 40 ensures that the TE10 mode electric field maximum occurs coincident with probe 12 for efficient energy transfer. But shorting cap 40 adds cost and occupies space that may be needed in some packages for other components.

SUMMARY OF THE INVENTION

This invention provides a waveguide to microstrip line coupling apparatus providing a transition for efficient high frequency signal transmission therebetween without the use of a shorting cap. This coupling apparatus includes a waveguide comprising a generally cylindrical wall open at a first end and a substrate having a ground plane conductor one side and a microstrip line coupled to a microstrip patch on an opposite side. The microstrip patch has a resonance with the waveguide encompassing a predetermined high radio frequency bandwidth of signals to be conducted by the apparatus. The waveguide has an end perpendicularly attached to the substrate surrounding and substantially centered on the microstrip patch and further has a wall opening adjacent the substrate through which the microstrip extends. A plurality of parallel conducting members form a via fence extending through the substrate that electrically connects the waveguide to the ground plane conductor; and the ground plane conductor extends substantially across the entire area on its side of the substrate that is bounded by the via fence.

BRIEF DESCRIPTION OF THE DRAWINGS

The present invention will now be described, by way of example, with reference to the accompanying drawings, in which.

DESCRIPTION OF EMBODIMENTS OF THE INVENTION

Figure 3:
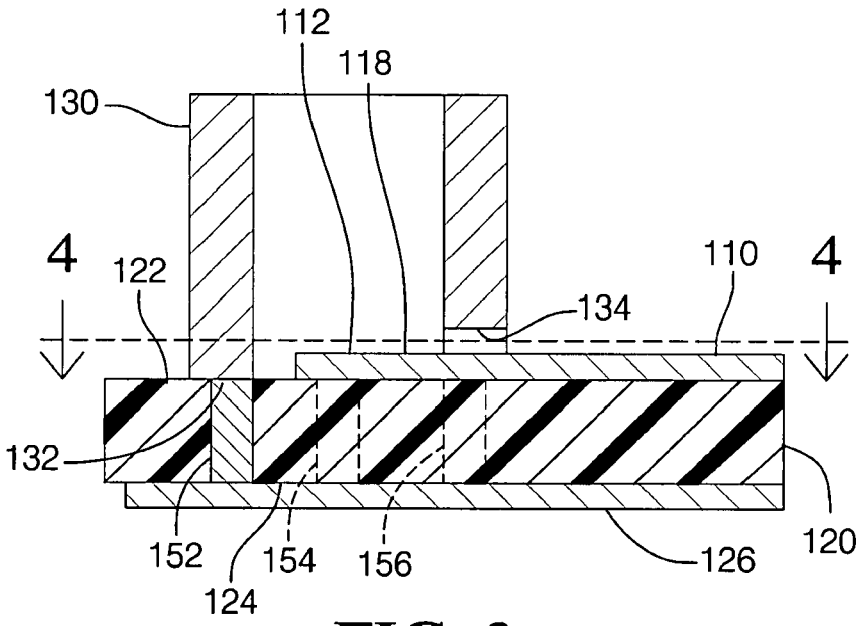
FIG. 3 is a cutaway view of an embodiment of a waveguide to microstrip line coupling of this invention, the view being through line 3-3 of FIG. 4.
Figure 4:
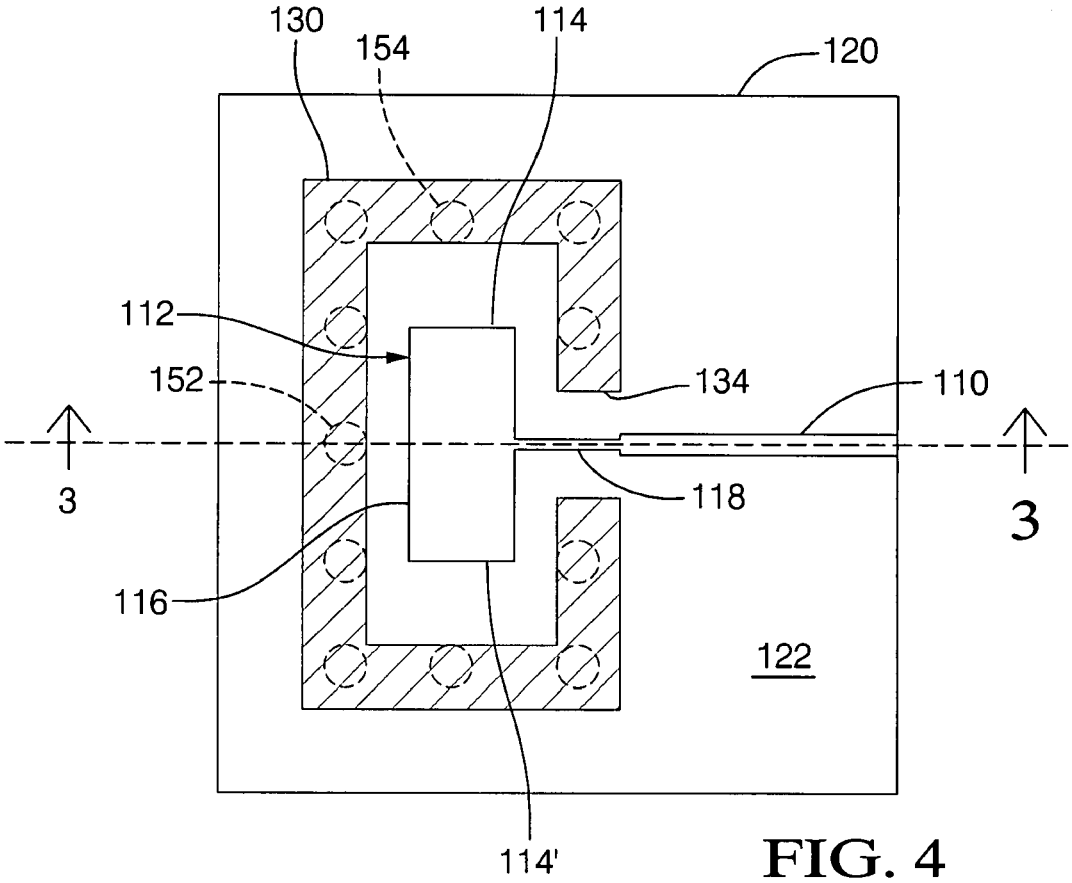
FIG. 4 is a section view through lines 4-4 of FIG. 3.

A first embodiment of the invention is shown in FIGS. 3 and 4. A substrate 120 is provided with a microstrip line 110 on a surface 122 thereof; and an electrically conducting ground layer is provided on an opposite surface 124 of substrate 120. Surfaces 122 and 124 appear in FIG. 3 as the upper and lower surfaces, respectively. Substrate 120 may be made, for example, from PTFE, Rogers 5880, 0.005 inch thick, or from any other substance known or to be developed in the art and having an appropriate dielectric constant and other properties suitable for such microstrip lines carrying high radio frequency signals. Likewise, microstrip line 110 and electrically conducting layer 126 may be made from any substances known or to be developed in the art and having conducting and other properties suitable for such elements carrying high radio frequency signals. Such high radio frequency signals in this embodiment may include at least microwave signals in the frequency band 75.5 to 77.5 GHz.

A microstrip patch 112 is further mounted on substrate 120 on the same side 124 and coupled to microstrip line 110. In this embodiment, microstrip line 110 and microstrip patch 112 are conveniently formed as a single electrical conductor of a common material and with the same thickness (perpendicular to surface 124); but the dimensions parallel to the substrate of microstrip line 110 and microstrip patch 124 are different. Microstrip patch 112 is, in this embodiment, flat and generally rectangular in shape with perpendicular sides 114 and 116, although it is not limited to such a shape. Microstrip patch 112 may be connected to microstrip line 110 through a one quarter wavelength impedance transformer 118 for impedance matching purposes, although it may not be required in all embodiments of the invention. In this embodiment, impedance transformer 118 is shown as a continuation of a common electrical conductor also comprising microstrip line 110 and microstrip patch 112, made from the same material with a length of one quarter wavelength at the center frequency and a width designed for optimal impedance matching. Thus, in this embodiment, a quarter wavelength impedance matching transformer having the same width as that of microstrip line 124 will be indistinguishable from microstrip line 124 itself; but in most cases these widths will be visibly different. This construction is convenient for manufacturing; but any suitable impedance matching device, such as shorting stubs, open stubs, etc., may be used.

A cylindrical waveguide 130 has an end 132 affixed to surface 122 of substrate 120, surrounding and, in this embodiment generally centered on, microstrip patch 112, with a wall opening 134 ("mouse hole") provided at the end 132 of waveguide 130 adjacent substrate 120 to accommodate microstrip line 110. In this document, the word "cylindrical waveguide" is used in a broad sense to mean an extended, hollow, electrically conducting member having a cross-sectional shape of any closed curve. In any particular embodiment, the size, material, cross-sectional shape, wall thickness and other details may be optimized to given specifications. In this embodiment, the waveguide is shown as a standard WR10 rectangular waveguide, although it may be provided with rounded corners for easier machining. It's size and other properties are suitable for efficient microwave conduction in a frequency band including and preferably greater than that of the signals to be transmitted through it. For the example given, the range of efficiently transmitted frequencies for the WR10 waveguide of this embodiment is 75 to 110 GHz, which encompasses the signal bandwidth of 75.5 to 77.5 GHz.

Figure 1:
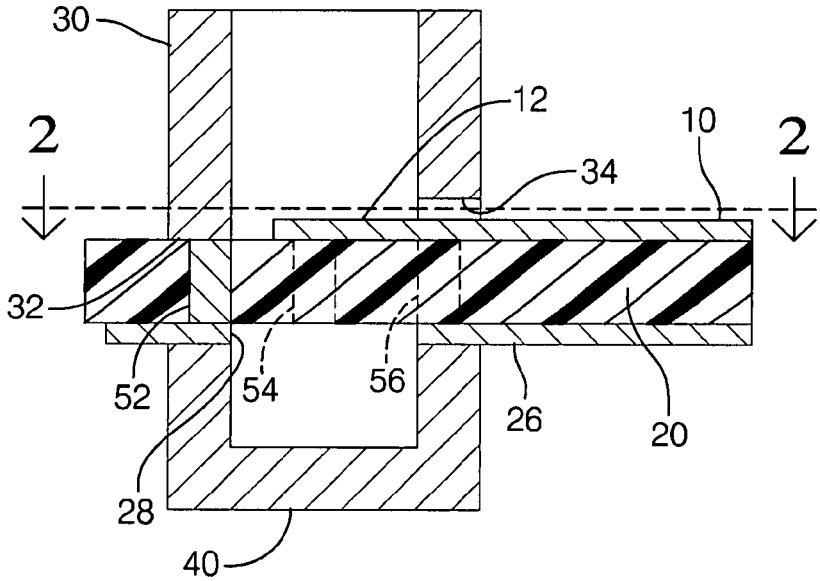
PRIOR ART FIG. 1
FIG. 1 is a cutaway view of a waveguide to microstrip line coupling of the prior art using a shorting cap, the view being through line 1-1 of FIG. 2.
Figure 2:
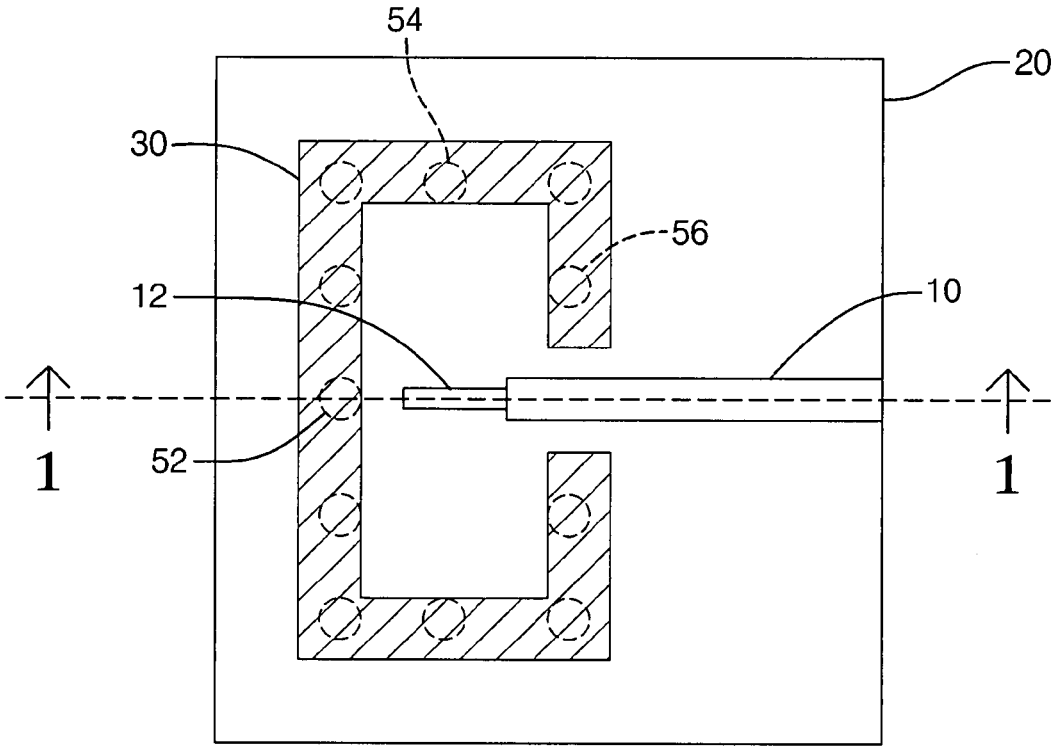
PRIOR ART FIG. 2
FIG. 2 is a section view through lines 2-2 of FIG. 1.

In order to provide efficient coupling between microstrip patch 112 and waveguide 130 for a desired signal bandwidth in the absence of the shorting cap 40 of the prior art shown in FIGS. 1 and 2, microstrip patch has physical characteristics providing a resonance with waveguide 130 encompassing a predetermined high radio frequency bandwidth of signals to be conducted by the apparatus. That is, the microstrip patch exhibits one or more resonant frequencies defining a resonant bandwidth both within the waveguide's bandwidth of efficiently transmitted frequencies and sufficient to cover that of the signals to be transmitted. Thus its optimal shape and dimensions will vary with the anticipated frequency range of the waveguide and the signal to be carried, the inner shape and dimensions of waveguide 130 (for physical fit) and the dielectric properties of substrate 120. In this embodiment, the resonant frequency of the rectangular patch depends on the length of its sides 114 and 114' parallel to the microstrip line; and its bandwidth varies with its width in the perpendicular direction, indicated as side 116. In addition, the size of the patch required will vary inversely with the dielectric constant of the substrate. In this embodiment of FIGS. 3 and 4, patch 112 is small enough to fit within the open interior of waveguide 130 where it engages substrate 120.

In the absence of a shorting cap, the lower end of waveguide 130 is electrically closed by an extension of electrically conducting ground layer 126 substantially (that is, to the extent it is possible and practical) across the area of substrate 120 directly below waveguide 130. Complete coverage of this area is most desirable for minimum leakage of electrical energy from the coupling, although in some cases one or more small openings might be tolerated if they are otherwise necessary or confer other advantages. The electrical closure is supplemented by the provision of a plurality of electrically conducting members, represented by numbered members 152, 154, and 156, extending from end 134 of waveguide 130 through substrate 120 to ground layer 126 and electrically connecting waveguide 130 to ground layer 126. These electrically conducting members 152, 154, 156 et al are spaced from each other as shown around lower end 132 of waveguide 130 where it engages substrate 120 to electrically couple waveguide 130 to ground layer 126 and form a via fence to reduce leakage of electrical energy in the signal away from the coupling through substrate 120. It should be understood that additional electrically conducting members that are part of the plurality are shown in dashed lines but are not given reference numbers to avoid unnecessary clutter in the drawings.

Figure 5:
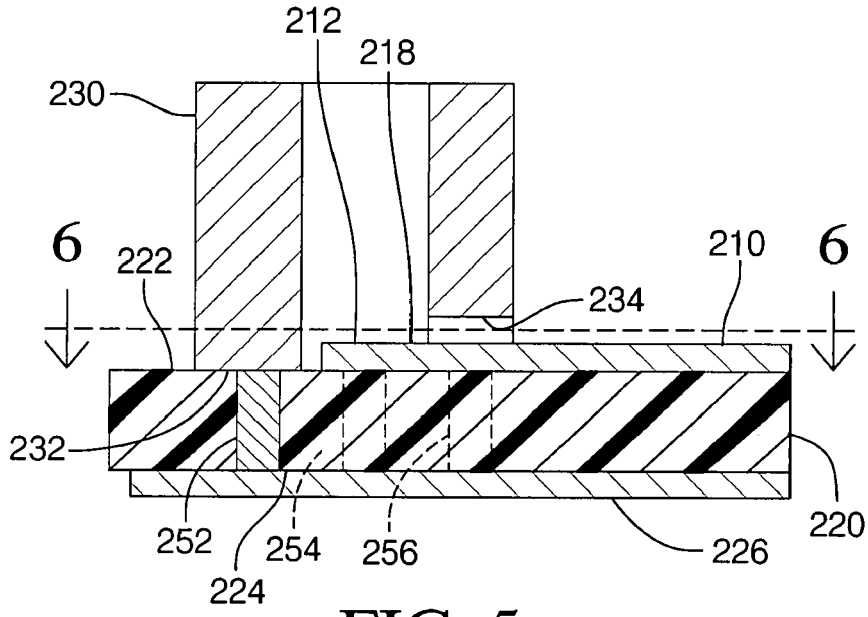
FIG. 5 is a cutaway view of another embodiment of a waveguide to microstrip line coupling of this invention, the view being through line 5-5 of FIG. 6.
Figure 6:
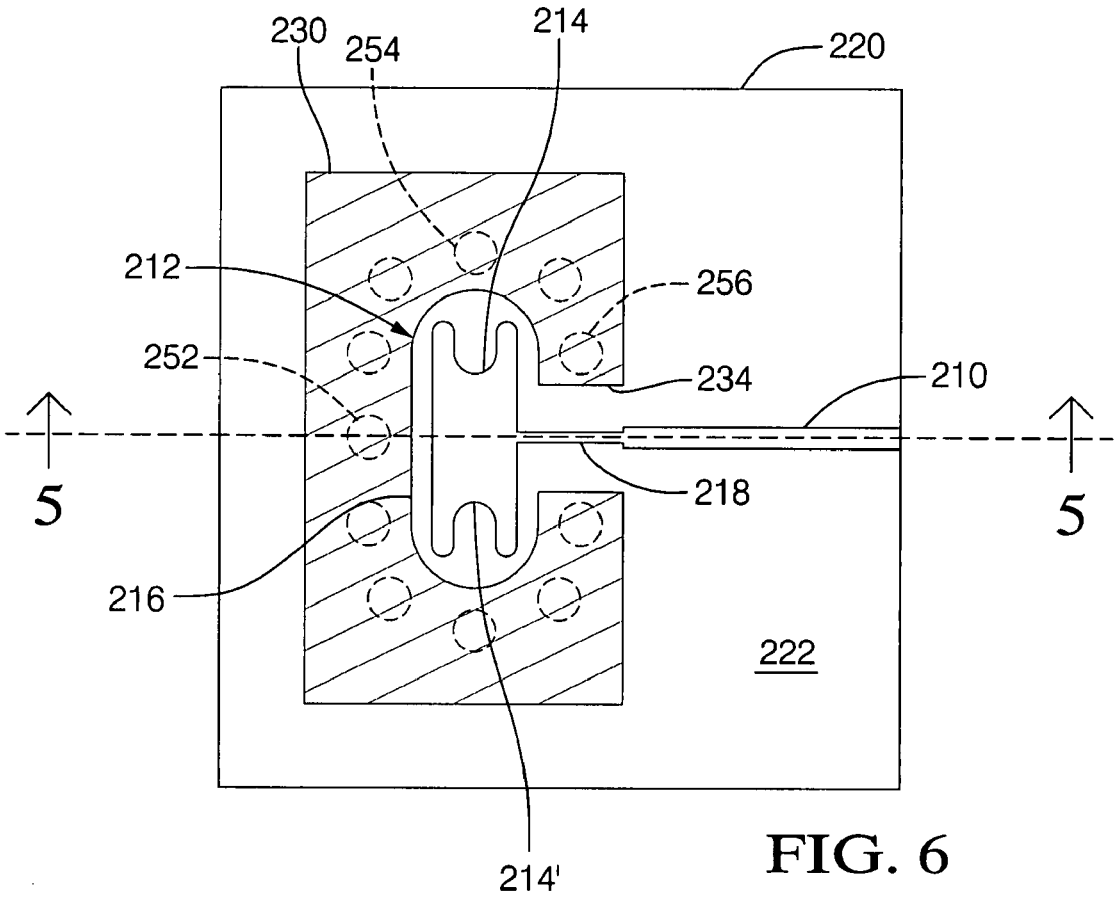
FIG. 6 is a section view through lines 6-6 of FIG. 5.

Another embodiment of the invention, shown in FIGS. 5 and 6, permits its use when a rectangular microstrip patch similar to that of FIGS. 3 and 4 is too large to fit within the cross-sectional opening of waveguide 130 of FIGS. 3 and 4, due, for example, to use of a waveguide 230 of smaller interior size and/or a significantly smaller dielectric constant in substrate 220 requiring a larger microstrip patch for the same resonant frequency. This embodiment differs from that of the previous embodiment shown in FIGS. 3 and 4 in the configuration of microstrip patch 212, which is generally rectangular but with sides 214 and 214', which determine the resonant frequency, bent toward each other in a concave manner. The word "bent" is used to mean deviating from a single straight line, regardless of whether the "bend" is curved or angular; and the word "concave" is used only to help specify the direction of the deviation and is not meant to limit the exact shape of that deviation. In particular, sides 214 and 214' of this embodiment are shown as arcuately bent; but the invention is not limited to an arcuate shape. Since the electrical length of the patch in this direction is determined by the distance current flows along these inwardly bent sides, the electrical length of the patch is greater than its overall physical length; and a resonant patch using the configuration of this embodiment can be used with a smaller waveguide than a resonant patch using the configuration of FIGS. 1 and 2.

The bent concave sides 214 and 214' are not limited to any particular shape, as long as the edge length traced along the side between its endpoints is greater than the length measured directly between the same end points. In this embodiment, the wall of waveguide 230 is also shown in FIG. 6 with rounded interior corners; but this is a result of one manner of its manufacture (drilling) and is not a requirement or characteristic of the invention. In addition, the purpose of the matching curved corners of the patch shown in FIG. 6 is only to ensure a lack of physical interference between the corners of the patch and the rounded interior corners of the waveguide explained in the previous sentence and is also not a requirement of the invention. Other elements of this embodiment shown in FIGS. 5 and 6 with reference numbers in the 200 range correspond in structure and function to elements in the previous embodiment of FIGS. 3 and 4 with similar reference numbers in the 100 range.

Figure 7:
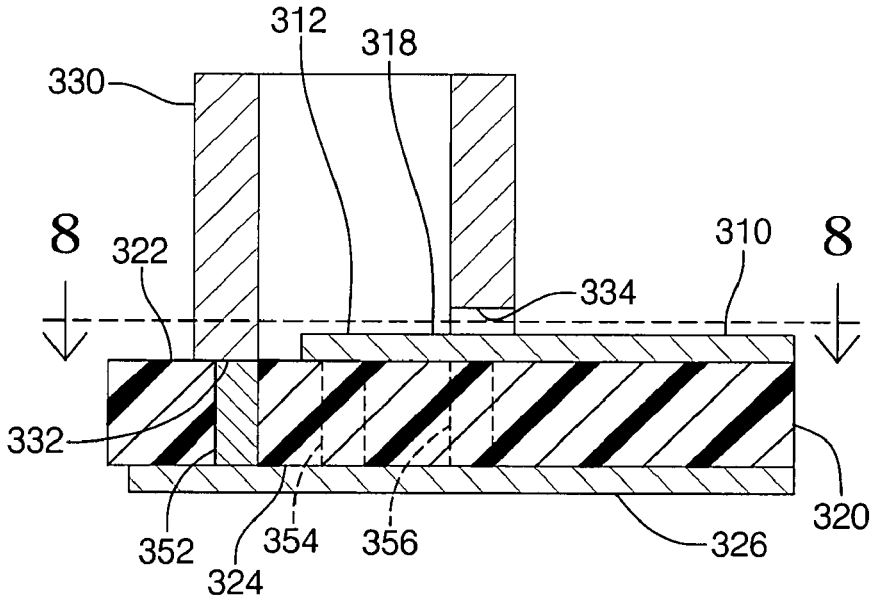
FIG. 7 is a cutaway view of another embodiment of a waveguide to microstrip line coupling of this invention, the view being through line 7-7 of FIG. 8.
Figure 8:
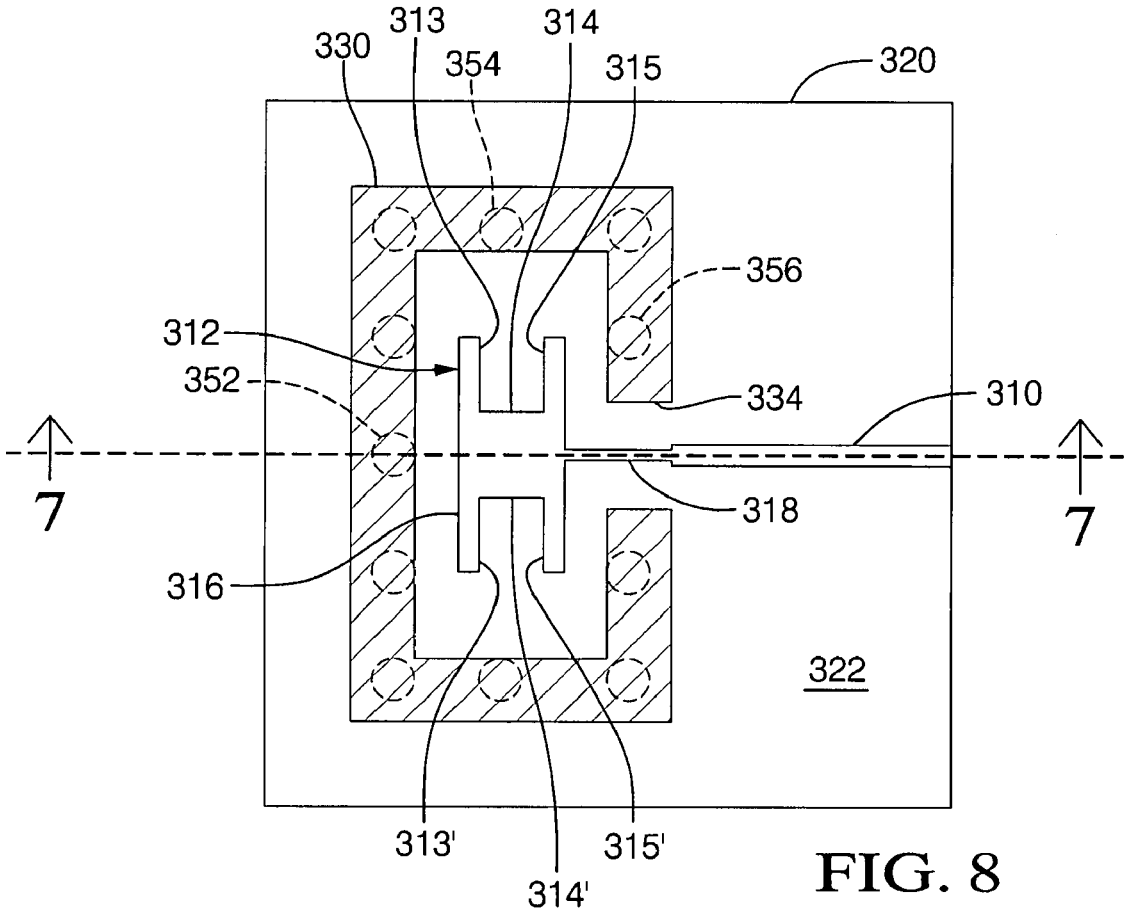
FIG. 8 is a section view through lines 7-7 of FIG. 5.

Yet another embodiment of the invention, shown in FIGS. 7 and 8, is a variation of the embodiment of FIGS. 5 and 6. It is similar to that of the previous embodiment in using arcuately bent opposite sides; but in this embodiment each bent side has three straight line segments. One of the opposite sides comprises connected line segments 313, 314 and 315, wherein segments 313 and 315 are both perpendicular, and segment 314 is parallel, to the direction of microstrip line 310 in FIG. 8. Likewise, the other of the opposite sides comprises connected line segments 313', 314' and 315', wherein segments 313' and 315' are both perpendicular, and segment 314' is parallel, to the direction of microstrip line 310 in FIG. 8. Thus, microstrip patch 312 is generally rectangular but with each of side 313, 314, 315 and side 313', 314', 315' bent toward each other in a concave manner; and the arrangement in this embodiment provides microstrip patch 312 with the shape of the letter "H." Each of the third and fourth sides of microstrip patch 312, for example side 316 of FIG. 8, is shown as a straight line segment. Microstrip patch 312 can thus also be used when a microstrip patch as shown in FIG. 2 is too large to fit within the cross-sectional opening of the waveguide 330. The word "bent" is again used with the meaning deviating from a single straight line, and the word "concave" is used only to help specify the direction of the deviation and is not meant to limit the exact shape of that deviation. The segments 313, 314, 315, 313', 314' and 315' comprising the opposite concave sides in this embodiment are shown as laid out in an orthogonal manner; but they need not be so and could be at non-orthogonal angles with each other and/or the microstrip line. In addition, the sides may comprise a combination of straight and curved lines as conceived by a designer of a particular embodiment.

Figure 9:
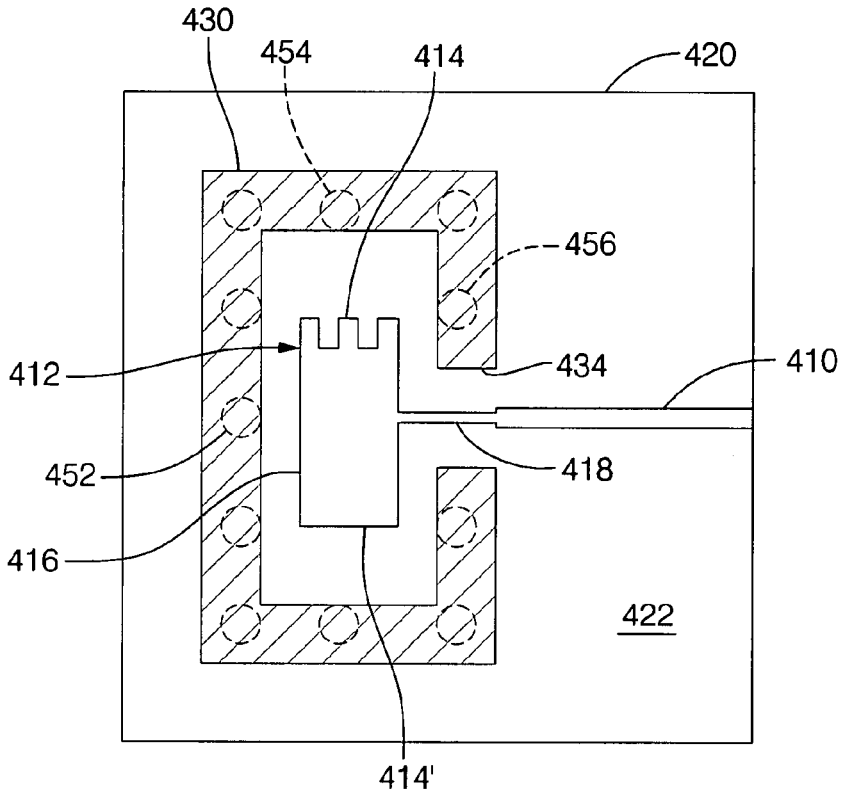
FIGS. 9 and 10 are views similar to those of FIG. 4 showing variations in the microstrip patch for further embodiments of the invention.
Figure 10:
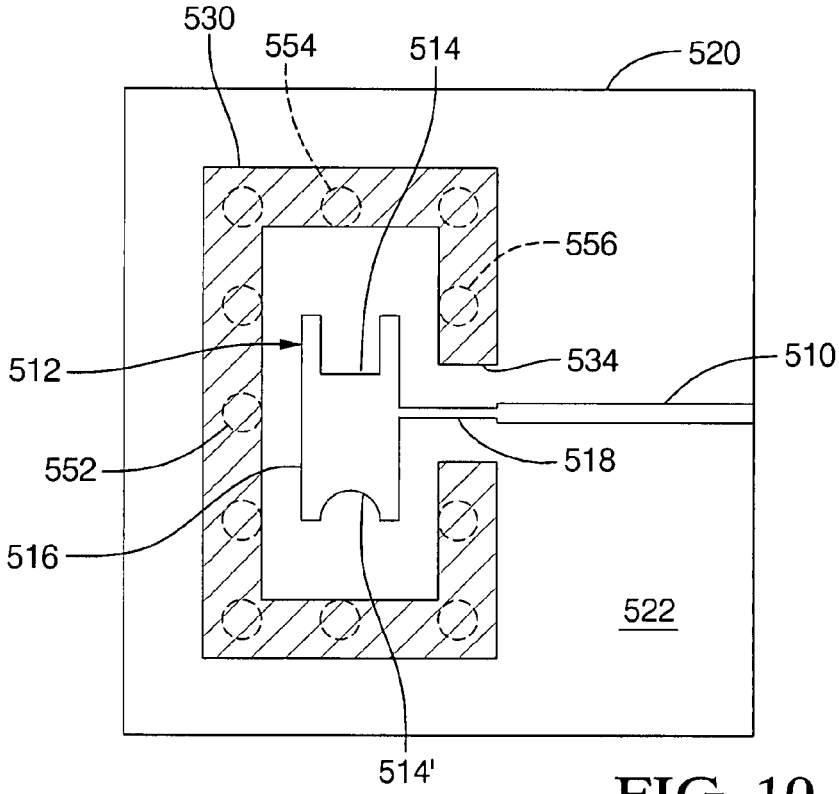

FIGS. 9 and 10 show additional variations of the microstrip patch of this invention illustrating that the opposite sides 414 and 414' need not be symmetrical with one another or have the same edge length (and thus current path length). In the embodiment of FIG. 9, microstrip patch 412 has a side 414 generally aligned with microstrip line 410 exhibiting a comb-like structure in which concave portions alternate with convex portions. Side 414 has an edge length greater than the straight edge length of opposite side 414', which is also generally aligned with microstrip line 410. In this embodiment, there will be two resonances, one from each of the opposite sides, which provide an additional design adjustment for the shaping of the overall resonant bandwidth. The same is true for microstrip patch 512 of FIG. 10, which has opposite sides 514 and 514' generally aligned with microstrip line 510 and having different edge lengths. In addition, FIG. 10 illustrates that the opposite sides determining the resonant frequency or frequencies can incorporate a variety of shapes that can differ in a variety of ways. Choice of the precise shape of the sides of the microstrip patch of this invention will determined as much by the practical considerations of manufacturing as by electrical considerations, as long as each of the waveguide and the microstrip patch have a resonance bandwidth encompassing the predetermined bandwidth of the signals to be conducted though the coupling apparatus.

The invention claimed is:

1. High frequency electrical waveguide to microstrip line coupling apparatus comprising:

a waveguide comprising a generally cylindrical wall;

a substrate having a ground plane conductor one side and a microstrip line coupled to a microstrip patch on an opposite side, the microstrip patch having a resonance with the waveguide encompassing a predetermined high radio frequency bandwidth of signals to be conducted by the apparatus, the waveguide having an end perpendicularly attached to the substrate surrounding and substantially centered on the microstrip patch and further having a wall opening adjacent the substrate through which the microstrip extends; and a via fence comprising a plurality of parallel conductors aligned with the waveguide wall and extending through the substrate to electrically couple the waveguide to the ground plane conductor, the ground plane conductor extending substantially across the entire area of the substrate bounded by the via fence.

2. The high frequency waveguide to microstrip line coupling apparatus of claim 1 wherein the microstrip line is coupled to the microstrip patch through a quarter wavelength impedance transformer.

3. The high frequency electrical waveguide to microstrip line coupling apparatus of claim 2 wherein the microstrip line, quarter wavelength impedance transformer and microstrip patch comprise a single, continuous electrical conductor.

4. The high frequency waveguide to microstrip line coupling apparatus of claim 1 wherein the patch has a pair of opposite sides generally aligned with the microstrip line having edge lengths tuned to help determine the predetermined high radio frequency bandwidth.

5. The high frequency electrical waveguide to microstrip line coupling apparatus of claim 4 wherein the microstrip patch is substantially rectangular.

6. The high frequency electrical waveguide to microstrip line coupling apparatus of claim 4 wherein at least one of the opposite sides is bent toward the other to provide a longer current path than that of a straight side having the same end points, whereby the tuned wavelength of the microstrip patch is longer than that produced by straight sides having the same ends.

7. The high frequency electrical waveguide to microstrip line coupling apparatus of claim 6 wherein the at least one of the opposite sides is at least partially arcuate.

8. The high frequency electrical waveguide to microstrip line coupling apparatus of claim 7 wherein the at least one of the opposite sides comprises one of a circular arc and an elliptical arc.

9. The high frequency electrical waveguide to microstrip line coupling apparatus of claim 6 wherein the opposite sides are both arcuate.

10. The high frequency electrical waveguide to microstrip line coupling apparatus of claim 6 wherein at least one of the opposite sides comprises at least two non-parallel lines, at least one of which is a straight line segment.

11. The high frequency electrical waveguide to microstrip line coupling apparatus of claim 10 wherein the at least one of the opposite sides comprises a plurality of straight line segments.

12. The high frequency electrical waveguide to microstrip line coupling apparatus of claim 11 wherein each of the opposite sides comprises a plurality of straight line segments.

13. The high frequency electrical waveguide to microstrip line coupling apparatus of claim 4 wherein at least one of the opposite sides comprises a convex portion between a pair of concave portions.

14. The high frequency electrical waveguide to microstrip line coupling apparatus of claim 1 wherein the microstrip line and microstrip patch comprise a single, continuous electrical conductor.

* * * * *